US010363562B2

(12) United States Patent
Callens et al.

(10) Patent No.: US 10,363,562 B2
(45) Date of Patent: Jul. 30, 2019

(54) APPARATUS TO REDUCE SIZE OF MATERIAL

(71) Applicant: MAYFAIR VERMÖGENSVERWALTUNGS SE, Hamburg (DE)

(72) Inventors: Rony Callens, Niort (FR); Eric Schroeder, Athus (BE)

(73) Assignee: Mayfair Vermögensverwaltungs SE (DE)

( * ) Notice: Subject to any disclaimer, the term of this patent is extended or adjusted under 35 U.S.C. 154(b) by 730 days.

(21) Appl. No.: 14/914,174

(22) PCT Filed: Aug. 19, 2014

(86) PCT No.: PCT/EP2014/067650
§ 371 (c)(1),
(2) Date: Feb. 24, 2016

(87) PCT Pub. No.: WO2015/028354
PCT Pub. Date: Mar. 5, 2015

(65) Prior Publication Data

US 2016/0199843 A1 Jul. 14, 2016

(30) Foreign Application Priority Data

Aug. 28, 2013 (DE) ..... 10 2013 217 164

(51) Int. Cl.
*B02C 13/00* (2006.01)
*B02C 13/28* (2006.01)
*B02C 13/20* (2006.01)

(52) U.S. Cl.
CPC ..... *B02C 13/2804* (2013.01); *B02C 13/205* (2013.01)

(58) Field of Classification Search
CPC ..... B02C 13/205; B02C 13/02
(Continued)

(56) References Cited

U.S. PATENT DOCUMENTS 702,426 A 6/1902 Hennessey
2,338,373 A * 1/1944 Aurig ..... B01D 47/08 241/188.2
(Continued)

FOREIGN PATENT DOCUMENTS

DE 102013206275.3 10/2014
JP 03-032755 2/1991
(Continued)

OTHER PUBLICATIONS

International Search Report and Written Opinion of the International Searching Authority, International Patent Application No. PCT/EP2014/067650, dated Nov. 3, 2014, 12 pages.
(Continued)

*Primary Examiner* — Faye Francis
(74) *Attorney, Agent, or Firm* — Barnes & Thornburg LLP

(57) ABSTRACT

Apparatus to reduce size of a light, dry, fibrous material, particularly straw, with a material supply area (1), an impeller (2) and a material release area (5) for the size reduced material as well as a ring element (4), which is arranged with a distance to the impeller (2), wherein least one size reduction tool (6) is provided at the impeller (2) and/or at the ring element (4), that is provided angular shaped, particularly L-shaped, or having the shape of a polygonal, particularly ashlar-formed, hollow profile or solid profile. Splitting particularly hard, closed fibrous structures such as nodes of straw can thereby be enabled to a major portion without excessive shortening of the straw.

16 Claims, 5 Drawing Sheets

Figure 1:
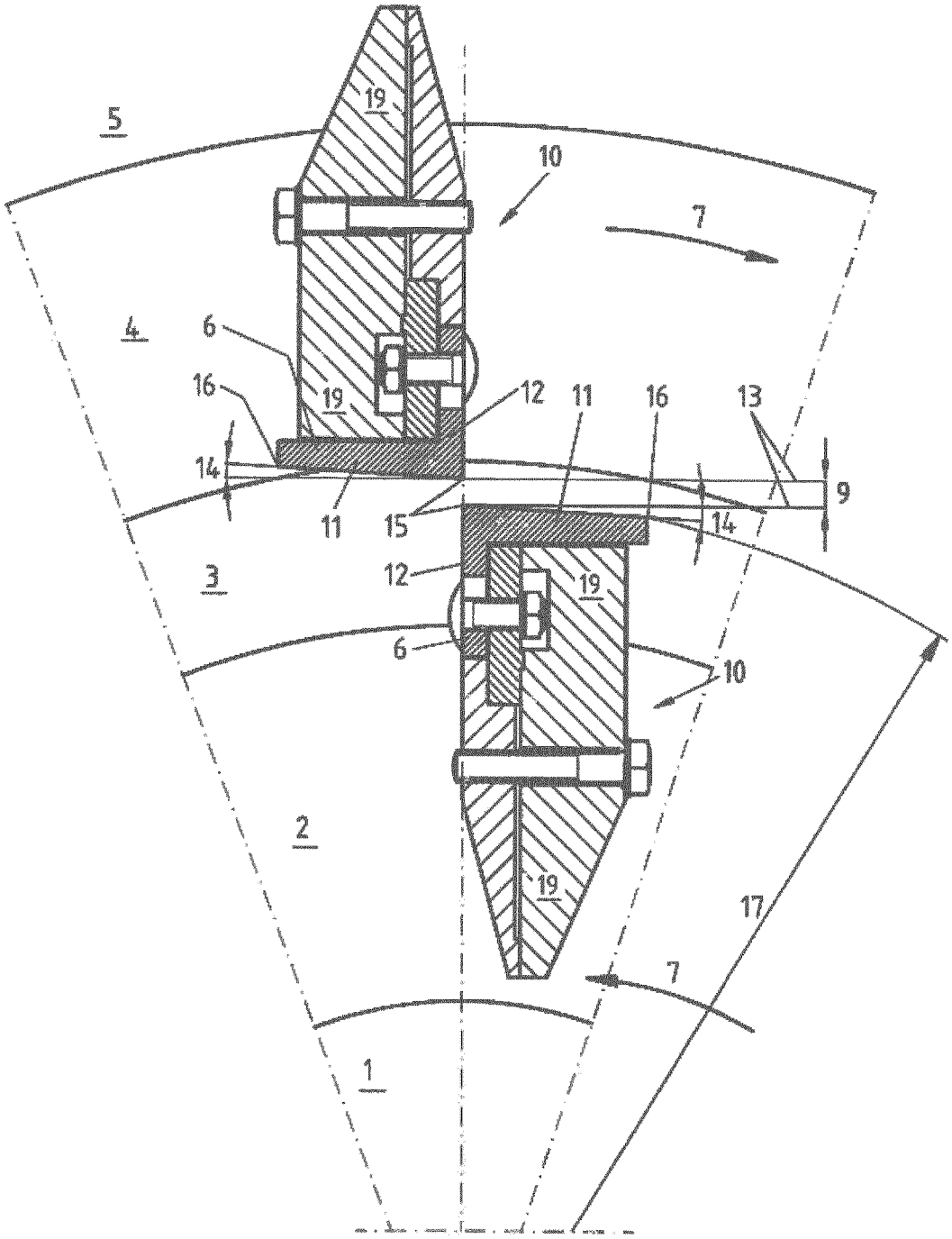

(58) Field of Classification Search
USPC ..... 241/188.1, 188.2, 191, 195
See application file for complete search history.

(56) References Cited

U.S. PATENT DOCUMENTS

| | | | | | |
|---|---|---|---|---|---|
| 2,747,803 | A * | 5/1956 | Hanse | B02C 13/2804 | 241/191 |
| 3,082,962 | A * | 3/1963 | Parten | B02C 13/00 | 241/186.5 |
| 3,411,724 | A * | 11/1968 | Noe | B02C 13/20 | 241/188.2 |
| 3,549,093 | A * | 12/1970 | Pallmann | B27L 11/02 | 241/154 |
| 3,680,797 | A | 8/1972 | Covey | | |
| 3,873,034 | A * | 3/1975 | Iwahori | D21B 1/12 | 241/55 |
| 3,917,175 | A * | 11/1975 | Maeda | B02C 13/13 | 241/52 |
| 4,061,281 | A | 12/1977 | Gundlach et al. | | |
| 4,325,516 | A * | 4/1982 | Ismar | A21D 17/002 | 241/152.2 |
| 4,360,168 | A * | 11/1982 | Peterson, Jr. | B02C 18/186 | 241/294 |
| 4,406,409 | A * | 9/1983 | Durek | B02C 13/288 | 241/188.1 |
| 4,479,613 | A * | 10/1984 | Rowledge | B02C 13/13 | 241/188.1 |
| 4,702,426 | A * | 10/1987 | Citterio | B02C 13/2804 | 241/167 |
| 4,930,710 | A | 6/1990 | Hench | | |
| 5,009,371 | A * | 4/1991 | Nickel | B02C 13/205 | 241/187 |
| 5,062,575 | A * | 11/1991 | Barnabie | B02C 13/282 | 241/189.2 |
| 5,083,713 | A * | 1/1992 | Kanda | B02C 13/06 | 241/15 |
| 5,419,499 | A * | 5/1995 | Bourne | B02C 13/06 | 241/18 |
| 5,564,635 | A | 10/1996 | Terada et al. | | |
| 6,435,433 | B1 * | 8/2002 | Hesch | B02C 13/205 | 241/186.35 |
| 6,533,200 | B2 * | 3/2003 | Paper | B02C 18/145 | 241/197 |
| 6,926,215 | B2 * | 8/2005 | Elliott | B02C 13/02 | 241/188.1 |
| 8,789,785 | B2 * | 7/2014 | Lelas | B02C 13/20 | 241/188.1 |
| 9,174,220 | B2 * | 11/2015 | Lucas | B02C 13/00 | |

FOREIGN PATENT DOCUMENTS

| | | |
|---|---|---|
| JP | 06-093585 | 4/1994 |
| JP | 08-284084 | 3/1995 |
| JP | 07-189152 | 7/1995 |
| JP | 08-215595 | 8/1996 |
| JP | 2003-112070 | 10/2001 |
| JP | 2001-334159 | 12/2001 |
| WO | 2012013653 | 2/2012 |
| WO | 2014166797 | 10/2014 |

OTHER PUBLICATIONS

International Preliminary Report on Patentability and Written Opinion of the International Searching Authority, International Patent Application No. PCT/EP2014/067650, dated Mar. 1, 2016, 10 pages.

Notification of Reason for Refusal for Application JP 2016-515977, dated Nov. 22, 2016, 6 pages (English Translation of same, 5 pages).

* cited by examiner

APPARATUS TO REDUCE SIZE OF MATERIAL

CROSS-REFERENCE TO RELATED APPLICATIONS

This application is a national stage entry under 35 USC § 371(b) of PCT International Application No. PCT/EP2014/067650, filed Aug. 19, 2014, and claims the benefit of German Patent Application No. 102013217164.1, filed Aug. 28, 2013, both of which are expressly incorporated by reference herein.

DESCRIPTION

The invention concerns an apparatus to reduce size of a light, dry, fibrous material, particularly straw.

Examples of light, dry, fibrous material are leaves, algae, bamboo, grass, straw, recycling paper and old wrappings with appropriate properties.

During manufacturing of OSSB panels (oriented structural straw board), the size reduction of straw represents an important work step. The quality of the size reduction process and the later OSSB panel quality can be evaluated based on certain criteria. The straw shall be split, i.e. strands shall be size reduced for example to half shells, so that they can be glued well and pressed densely later on and an appealing optical surface of the panel can be created. Analogously, basically all closed structures of the material, for example nodes of the strands, shall be opened or split by means of the size reduction process. At the same time, despite the size reduction, the length of the straw and the fibrous structure shall be preserved as much as possible for optical and mechanical reasons. For similar reasons, a possibly small fines portion of is sought.

During manufacturing of shaped piece made of synthetic resin densified wood, which are for example known under the trade names Delignit, Dehonit, Lignostone and Werzalit, similar requirements are made like for the manufacturing of OSSB panels. Therefore, the light, dry, fibrous material, particularly straw, within the meaning of the present application, could also be used for the manufacturing of shaped pieces following the synthetic resin densified wood process, if the mentioned requirements are met.

Refiners with a commonly cylindrical shaped grinding tool, wherein material is continuously grinded or rubbed over its rotating surface, can be basically used to reduce size of straw. However, the high split rate is opposed by a high fines portion and a sufficient length and fibrous structure of the straw cannot be obtained by means of size reduction with a refiner.

A process and an apparatus for the size reduction of light, dry, fibrous materials, particularly straw, are known from the German patent application 10 2013 206 275.3. The therein disclosed apparatus reduces size of the straw in a way that due to centrifugal forces the straw moves radially outward along a beating bar fixed to an impeller. Radial to the beating bar there is a gap provided towards a beating edge. The beating bar and the beating edge are particularly realized by means of simple wear plates. The radial moving straw hit the beating edge and gets split and size reduced due to the collision. Strands of the straw can be split by this apparatus and process to a major portion into half shells. However, the disclosed apparatus and process cannot split the nodes of the straw to a major portion, which usually appear with a distance of about 120 mm in the strands and have a comparatively high strength. The size reduced material is therefore not optimal suitable for use manufacturing high quality OSSB panels.

The underlying problem of the invention is to provide a further developed apparatus to reduce size of light, dry, fibrous materials, particularly straw, which can reduce the size of material in a more appropriate way.

An apparatus configured to reduce size of a light, dry, fibrous material as provided in this application serves to solve the problem.

The problem is solved by means of an apparatus to reduce size of a light, dry, fibrous material, particularly straw, with a material supply area, an impeller and a material release area for the size reduced material as well as a ring element, which is arranged with a distance to the impeller. At least one size reduction tool is arranged at the impeller and/or at the ring element. The size reduction tool is provided angular shaped, particularly L-shaped, or has the shape of a polygonal, particularly ashlar-formed, hollow profile or solid profile.

A size reduction tool with angular shape, particularly L-shape, or with the shape of a polygonal, particularly ashlar-formed, hollow profile or solid profile enables to provide two surfaces, wherein a first surface can reduce size of the material by means of beating and a second surface by means of grinding.

Usually, a skilled person would not dimension an even plate, as applied in already known apparatuses for reduce size of materials, thicker than necessary for the required mechanical strength. An increased thickness means higher material consumption, higher weight and larger constructed space needs. But exactly that bigger extensiveness or plate thickness than necessary for the strength would be required to provide the second surface, which is able to reduce size of material by means of grinding within the meaning of the present invention.

Beating means one-time hit, crash or bounce under high kinetic energy. For beating it is not relevant, whether a moved body hit a still standing body, a move in the same direction at different speed cause the hit or move in opposite directions of two bodies are the reason for a collision.

Grinding means, that a size reduction occurs within a gap between two opposite surfaces, wherein both grinding surfaces move relative to each other. If the surfaces are even, the size reduction is facilitated by rubbing, shearing and/or squeezing. If one or both surfaces provide a side-face with a multiplicity of hollows and/or protrusions, the size reduction will be caused in addition by means of continuous, multiple hits. Such a continuous, multiple hitting within a coherent side-face is no beating within the meaning of the present invention.

Thus, a size reduction tool with angular shape or with the shape of a polygonal hollow profile or solid profile can reduce size of material more appropriately, so that a major portion of solid fibrous structures are reliably split. During processing of straw, split rates of the nodes in the straw of over 50%, regularly over 75% or even above 90% can be achieved.

A size reduction tool with angular shape is notably saving material. With an L-shape, not only material can be saved, but also a space-saving connecting device to the impeller or ring element can be provided. A hollow profile is also notably material saving. A solid profile can be manufactured with few production expenses.

In one embodiment, a leg of the angular shaped size reduction tool is connected to the impeller or ring element and a second leg is connected to the first leg, wherein particularly the second leg is facing a shearing area between impeller and ring element.

A size reduction tool can hereby be manufactured with notably little volume and material.

In one embodiment, the ring element is rotatable. By means of a rotatable ring element, a notably high relative shearing speed between impeller and ring element can be generated.

In one embodiment, a leg of the angular shaped size reduction tool or a side of the polygonal profile extend at least substantially tangentially to the ring element or to the impeller. The leg or the side is facing a shearing area between impeller and ring element.

A shearing area is the area between impeller and ring element, in which a shearing motion is usually produced by an opposing relative motion between impeller and ring element.

At least substantially tangentially to the ring element or to the impeller means that a body is aligned in or angular to a tangent plane.

By means of the at least substantially tangential alignment of the leg of the angular shaped size reduction tool or the shearing area facing side of the polygonal profile, a size reduction tool with a first surface for beating the material and a second surface for grinding the material can be provided in notably simple manner.

In one embodiment, the at least substantially tangentially extend of the leg, i.e. leg length, or the side, i.e. side length, is chosen in a way that during size reduction of straw as material, nodes of the straw can be split to a portion bigger than 50%, preferably bigger than 75%, especially preferably bigger than 90% and at the same time an average length of the size reduced straw of bigger than 50 mm, preferably bigger than 75 mm, especially preferably bigger than 90 mm can be obtained.

This embodiment is based on the leading thought that at a too short chosen extend or length, a too little portion of nodes can be split, whereas at a too big chosen extend, the straw will be cut in too short strands. A length of the leg or the side, which can achieve an appropriate size reduction of material, enables the elimination of further following processing steps such as the screening of non split nodes after the size reduction process, and therefore the manufacturing of high quality panels with notably little production expense.

In one embodiment, the at least substantially tangentially extend of the leg, respectively leg length, or the side, respectively side length, is bigger than the smaller value of 30 mm or arc length of 3° angle, preferably 45 mm or arc length of 4.5° angle, especially preferably 60 mm or arc length of 6° angle, and/or smaller than the bigger value of 180 mm or arc length of 18° angle, preferably 130 mm or arc length of 13° angle, especially preferably 80 mm or arc length of 8° angle. The arc length refers herein to the outer circumference of the impeller or the inner circumference of the ring element.

Experiments have shown that by means of a size reduction tool with above described leg length or side length, high qualitative panels can be provided with notably little manufacturing expense.

In one embodiment, a leg or a side of the size reduction tool form an acute angle with a tangent.

Through applying an acute angle, it can be prevented that a high fines portion is generated and that the material is cut excessively in length, such that for example a notably short straw strand length is obtained.

In one embodiment, a distance in circumferential direction is provided between two size reduction tools at the impeller or between two size reduction tools at the ring element, which is equal or bigger than a at least substantially tangentially extend of the leg, respectively leg length, or the side, respectively side length, of the size reduction tool.

By means of the above described distance between two size reduction tools, a notably reliable material flow in direction of the material release area is enabled.

In one embodiment, the size reduction tool at the impeller has a front edge of an at least substantially tangentially extend of the leg or the side, wherein the front edge is arranged in rotation direction and in parallel or angular to an axis of the impeller.

By means of the above described arrangement and alignment of the front edge, a notably effective size reduction of material, particularly splitting of straw, can be achieved.

In one embodiment, the at least substantially tangentially extend of the leg or the side produce an acute angle with a tangent plane through the above described front edge. A minimum gap width between impeller and ring element during a relative shearing motion can thus be defined by the front edge, and a high fines portion as well as an excessively high shortening of the material length can be prevented.

In one embodiment, the size reduction tool provides at the impeller a front edge in rotation direction of the impeller and a back edge at the opposite end of the at least substantially tangentially extend of the leg or the side, wherein the radius of the back edge to an axis of the impeller is equal or smaller than the radius of the front edge to the axis of the impeller. The front edge can in particular correspond to the front edge according to one of the previous described embodiments. Preferably, the front edge and the back edge are facing a shearing area between impeller and ring element.

By means of the equal or smaller radius of the back edge compared to the front edge, it can be achieved that a minimum gap width, which is defined by the front edge, can remain nearly constant or at least cannot fall below it over the whole at least substantially tangentially extend of the size reduction tool during a relative shearing motion. An appropriate splitting of the material, particularly hard, closed fibrous structures, for example nodes in straw, can be obtained without excessive increase of the fines portion.

In one embodiment, a L-shaped size reduction tool with a first leg and a second leg is arranged angularly to a tangent plane. By means of a suitable, L-shaped size reduction tool, a size reduction apparatus can be provided with notably low manufacturing expense, which although can enable an at least nearly constant gap width during one turn of the impeller.

Favorable is a radial orientation of the first leg in order to maximize the beating force and to work against a fast material flow to the second leg and therewith a short grinding period.

In one embodiment, a size reduction tool is arranged each at the impeller and the ring element, particularly, wherein preferably the size reduction tool at the ring element is arranged relative to the orientation of the size reduction tool at the impeller 180° rotated around the axis of the impeller or ring element.

Through the application of a size reduction tool at the impeller and at the ring element, notably high efficiency and effectiveness of an appropriate size reduction process can be achieved.

In one embodiment, the at least substantially tangentially extend of the leg or the side provides a side-face at the surface that faces the shearing area, which particularly has saw teeth or notches in polygon shape, preferably rectangle shape, or rounded notches, preferably with U-shape or semicircle. As optional, the notches can be aligned radially, at least substantially radially or angular to radial direction and/or in parallel or angular to an axis of the impeller.

A side-face has in contrast to a smooth surface protrusions and/or hollows, which regularly form a repetitive pattern.

By means of a side-face particularly in the above described manner, respectively shape, a notably effective and efficient size reduction can be obtained.

In one embodiment, a side-face with the described shapes of the previous embodiment is arranged at an at least substantially radially extend in direction of a relative sharing motion between impeller and ring element. By providing a side-face at an at least substantially radially extend, a notably effective and efficient size reduction is enabled.

In one embodiment, the size reduction tool is featured as one-piece body, particularly as a metal casting part, preferably made of Ni-hard material. A one-piece size reduction tool can be manufactures with notably little expense, particularly through metal casting methods. Ni-hard is a special low wear material, which is well suitable for production with metal casting methods.

In one embodiment, the size reduction tool is part of a tool module, which connects the size reduction tool either with the impeller or with the ring element, wherein a tool module particularly comprises only one size reduction tool. Thanks to the fact that the size reduction tool is part of a tool module, the size reduction tool can be changed with notably little effort. Furthermore, different side-faces of size reduction tools can be notably easily varied and combined in order to enable a notably effective and efficient size reduction process and thereby adaptation to the material characteristics.

In one embodiment, a minimum gap width between impeller and ring element is adjustable, particularly by means of the relative position between the size reduction tool and a tool unit of a tool module, which is preferably detachably connected with the impeller or the ring element.

Thanks to the adjustability of the minimum gap width, a notably appropriate size reduction of materials can be enabled.

By means of the particularly detachable tool unit of the tool module, a notably fast and little effort adjustment, for example at an external station, can be enabled.

In one embodiment, there is arranged at the impeller and the ring element each at least one tool module or at least one size reduction tool, wherein preferably the tool modules or the size reduction tools are identical in construction. By the use of a tool module or size reduction tool for the apparatus to reduce size of material, which are arranged at the impeller or the ring element, the number of different parts can be reduced and an apparatus to reduce size of material can be provided with notably little production expense. Particularly when using tool modules or size reduction tools that are identical in construction, the apparatus to reduce size of material can be manufactured with notably little expense.

As optional, tool modules with size reduction tools that are not identical in construction can be applied when using a base body of the tool module with exchangeable size reduction tool as part of the tool module at the ring element or impeller, wherein the base body is particularly not identical in construction, and wherein the size reduction tools that are not identical in construction preferably differ in the side-face surface that faces the shearing area. By means of the combination of different size reduction tools with preferably different side-face surfaces, a notably effective and efficient size reduction can be achieved in an appropriate manner.

In one embodiment, the size reduction tool of one of the above described embodiments does not provide a sharp edge or knife for cutting. Through the abandonment of a sharp edge or knife, notably little manufacturing expense for the size reduction tool can be enabled.

In one embodiment, the apparatus to reduce size of material is a ring flaker, disk flaker, rotor flaker and cylinder flaker. Through the combination of the above embodiments with a ring flaker, disk flaker, rotor flaker and cylinder flaker, a notably effective size reduction of the materials can be achieved.

According to a further aspect of the invention, the above described tool module comprises a size reduction tool, which has no angular shape, but a side-face as described above. A surface in rotation direction has then in at least substantially radial direction only the expansion of the side-faces plus the necessary material thickness for the strength of the size reduction tool. Beating and grinding is then also rudimentally possible, but with less effectivity and efficiency. Nevertheless, notably little expense suffices for producing the apparatus.

The invention will be described in more detail based on exemplary embodiments as shown in the FIGS. 1 to 3. It is shown in:

FIG. 1: Detailed view of an apparatus to reduce size of material with a tool module and a size reduction tool at the ring element and the impeller as cross section.

Figure 2:
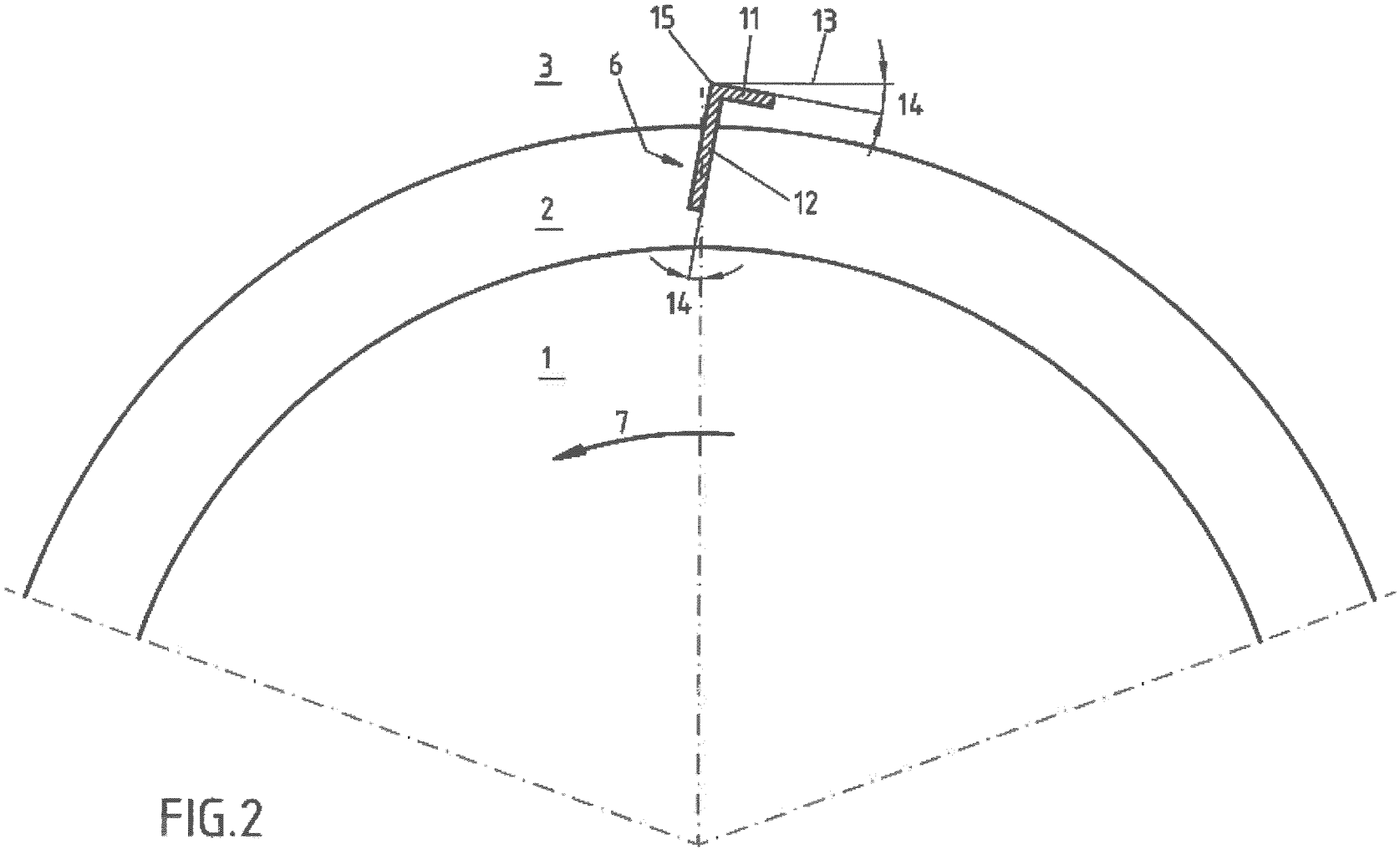

FIG. 2: Illustration of a size reduction tool at the impeller.

Figure 3:
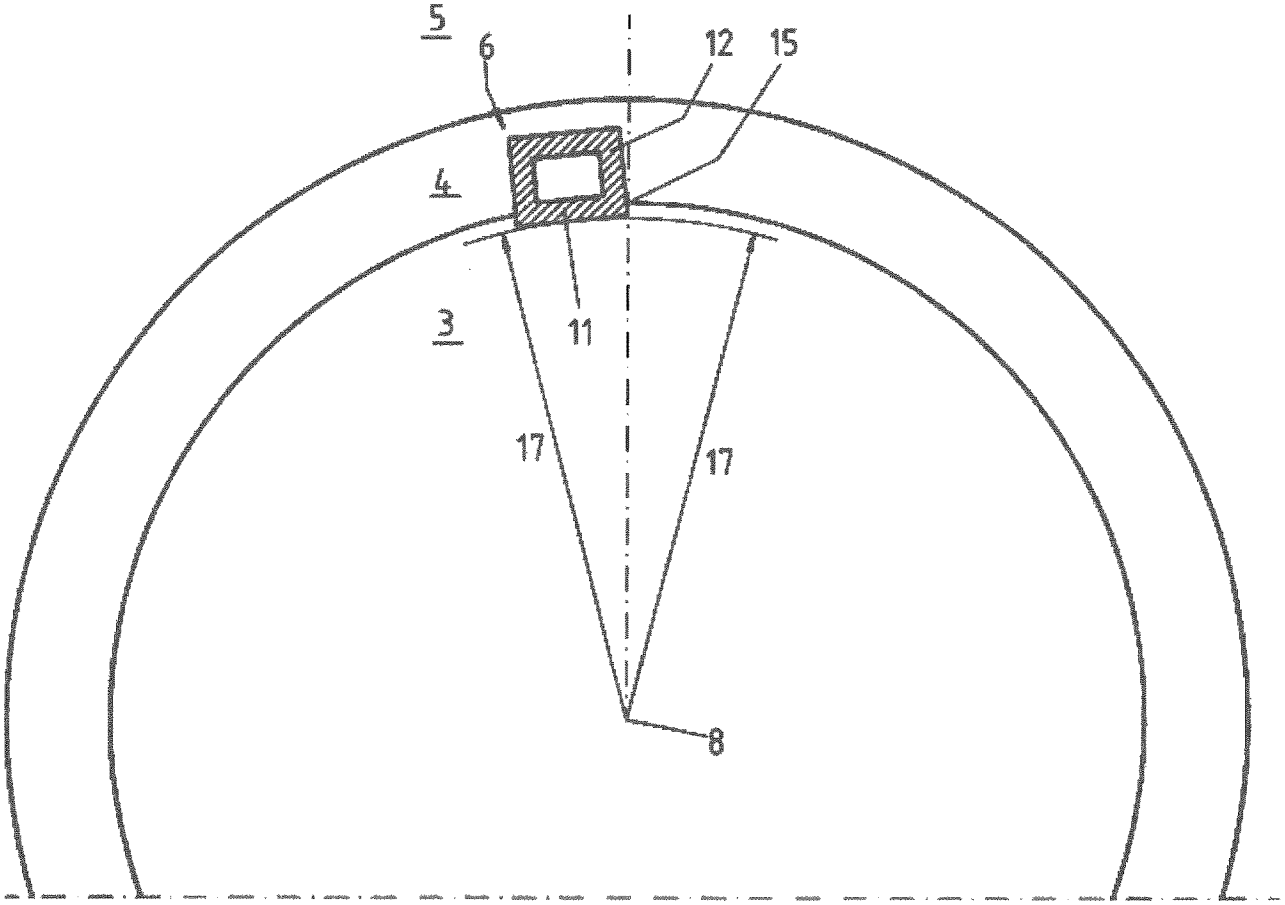

FIG. 3: Illustration of a size reduction tool at the ring element.

Figure 4:
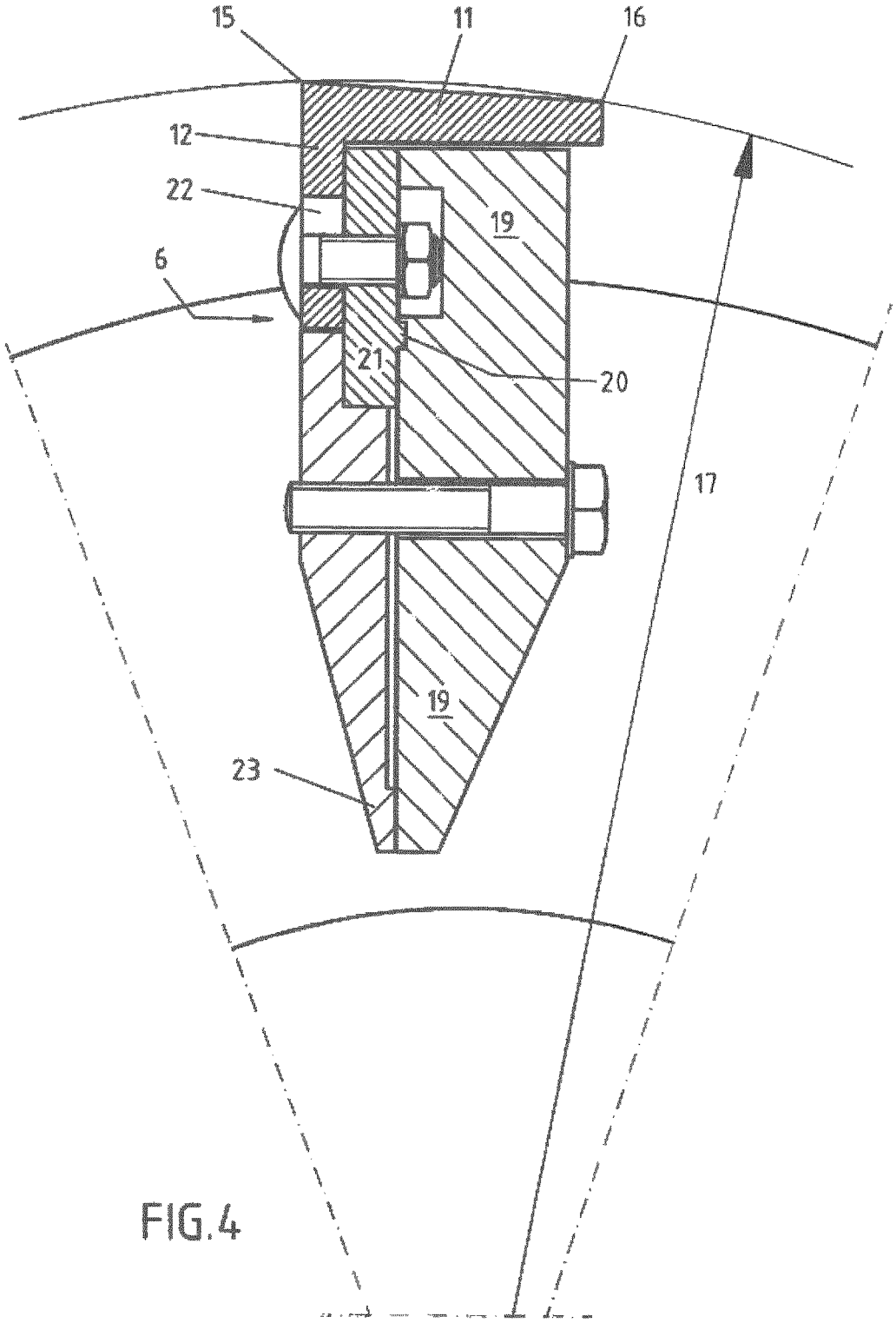

FIG. 4: Illustration of a tool module with a size reduction tool.

Figure 5A:
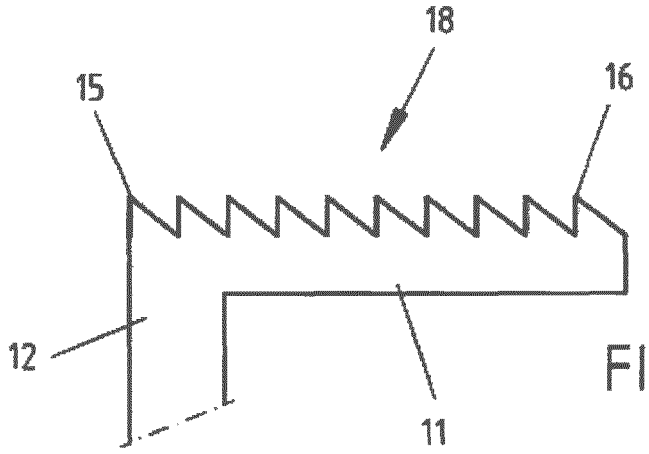

FIG. 5*a, b, c*: Side-face variants of the size reduction tool.

The exemplary embodiments as shown in the figures illustrate a size reduction machine for splitting straw for manufacturing OSSB panels, other panels made of long fibrous straw or shaped pieces made by the synthetic resin densified wood process such as table plates, chairs and other decorative products.

The straw moves from a material supply area 1 to the impeller 2, which rotates around the axis 8 during operations (FIGS. 1 and 3). Between the impeller 2 and the ring element 4, which is arranged with a distance to the impeller 2, there is a shearing area 3, in which the straw is split or respectively reduced in size through the relative shearing motion 7 of the size reduction tool 6 of the impeller 2 and the ring element 4. The ring element 4 is either firmly installed or can also rotate around the axis 8. For achieving the relative motion, the ring element 4 can either rotate in counter direction to the impeller 2 or rotate with different speed. After the size reduction in the shearing area 3, the size reduced straw modes in a material release area 5.

Depending on the required specifications of the size reduced straw, there can be arranged 1 to 50 tool modules 10 or size reduction tools 6 over the circumference of the impeller 2 and/or the ring element 4 with equal distance between each other. Preferably, 4 to 20 tool modules 10 or size reduction tools 6 are placed on the impeller and 12 to 30 tool modules 10 or size reduction tools 6 are placed on the ring element 4. By means of the distances between the tool modules 10 or the size reduction tools 6 in circumferential direction, a notably reliable removal of the size reduced material can be achieved. The diameter of the impeller 2 and/or the ring element 4 are in the range of 800 to 2000 mm depending on machine type. If the machine is bigger dimensioned and has bigger diameter, then a corresponding higher amount of tool modules 10 or size reduction tools 6 at the impeller 2 and/or ring element 4 are to be provided.

The size reduction tool 6 as in the FIGS. 1, 2, 4 and 5*a* to 5*c* shows an angular shape with two legs (11, 12), of which the tangential leg 11 extends at least substantially tangentially and the radial leg 12 extends at least substantially radially. The tangential leg 11 and the radial leg 12 form a L-shape, wherein L-shape means an at least substantially 90° angle between both legs. The tangential leg 11 is facing the shearing area 3.

The FIG. 2 shows an exemplary embodiment of a size reduction machine with a L-shaped size reduction tool 6, which is mounted at the impeller 2 and not part of a tool module 10.

The FIG. 3 shows an exemplary embodiment of a size reduction machine with a size reduction tool 6, which is mounted at the ring element 4 and has the shape of an ashlar-formed hollow profile. A side of the polygonal profile, or the tangential leg 11 respectively, extend at least substantially tangentially to the ring element 4.

The tangential leg 11 forms an acute angle with the tangent 13, wherein the angular point is formed by the shearing area 3 facing front edge 15 of the tangential leg in rotation direction or respectively the direction of the relative shearing motion.

The acute angle 14 is chosen in the exemplary embodiments of the FIG. 1 (only impeller), 2, 3 and 4 in a way that the radius 17 of the front edge 15 to the axis 8 and the radius 17 of the back edge 16 to the axis 8 are equal or nearly equal. Hereby it can be achieved that a minimum gap width 9 between impeller 2 and ring element 4 during one rotation is defined by the front edge 15. If the acute angle 14 would be smaller, then the gap 9 during the relative shearing motion along the tangential leg 11 would become smaller. However, in order to be able to only break the nodes of the straw without shortening the straw any further, a nearly constant gap during the shearing over each other of the size reduction tools 6 at the impeller 2 and the ring element 4 is notably productive.

In FIG. 1, the apparatus to reduce size of material provides at the impeller 2 and at the ring element 4 each at least one tool module 10 or respectively at least one size reduction tool 6. The tool modules 10 are identical in construction and arranged 180° rotated at the ring element 4 relative to the impeller 2. Herewith, the apparatus to reduce size of material can be manufactures with notably little expense. The acute angle 14 of the size reduction tool 6 at the ring element 4 correspond to the absolute value according to the acute angle 14 of the size reduction tool 6 at the impeller 2. The orientation of the acute angle 14 is however oriented in the opposite direction. The gap 13 will get thus bigger during the shearing over each other and therefore will not get reduced. The reduced production expense due to the lower amount of parts is opposed by a lower effectivity and efficiency for the spiting of nodes in the straw.

Figure 5B:
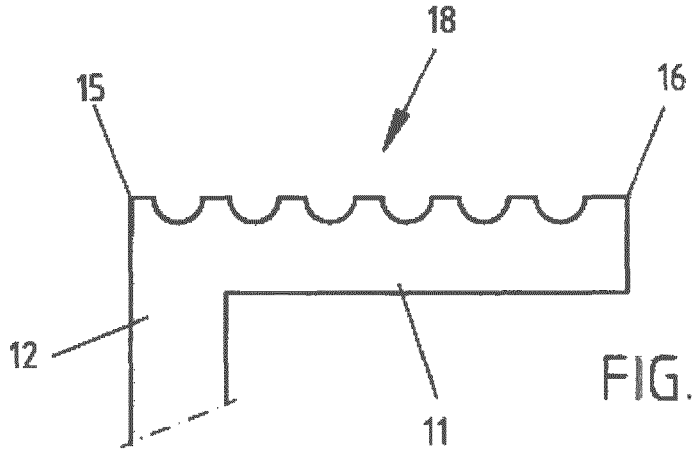
Figure 5C:
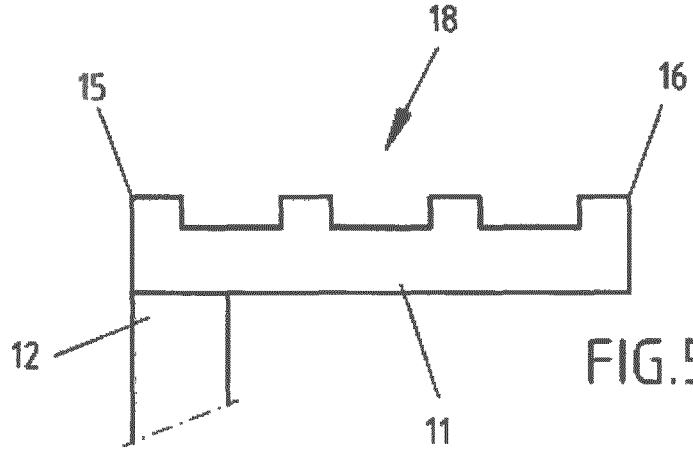

The FIGS. 5*a*, 5*b* and 5*c* show exemplary embodiments of an apparatus to reduce size of material with a tangential leg 11, which has a side-face at the surface that faces the shearing area 3. FIG. 5*a* shows a saw teeth side-face. FIG. 5*b* shows a side-face with rounded notches with U-shape. FIG. 5*c* shows a side-face with rectangular hollows or notches with rectangular shape respectively. A side-face 18 can also be provided for the radial leg, which is not shown in the figures, though.

The size reduction tool 6 in FIG. 5*c* comprises a plate shaped tangential leg 11 with a side-face 18 and a plate shaped radial leg 12, wherein tangential leg 11 and radial leg 12 are separate parts. This enables a notably high flexibility during set up the machine for special material specifications.

The size reduction tools 6 as shown in the other figures are one-piece made of Ni-hard material via metal casting methods. By means of all the shown exemplary embodiments, a split rate of straw and the nodes of at least 90% can be achieved at simultaneous retention of an average straw length of at least 90 mm. The minimum gap width 9 is regularly between 4 to 16 mm, preferably between 8 to 10 mm, depending on the properties of the straw.

The size reduction tool 6 as in FIG. 2 provides an exact 90° angle between both legs and is placed at the impeller 2 tilted, or rotated respectively, by the acute angle 14. The production expense for a 90° angular size reduction tool 6 is notably low. The gap width 9 can also retained nearly constant during a rotation of the impeller. However, these advantages are opposed by the fact that due to the tilt of the radial leg 12, the straw will move faster to the tangential leg 11 and sheared and size reduced for a shorter time period by means of the tangential leg 12. The consequence is a lower effectivity and efficiently of the size reduction process.

The FIG. 4 shows a detailed view of the tool module 10, which connects the size reduction tool 6 with the impeller 2 or as shown in FIG. 1 with the ring element 4. Starting point is the supporting means 19 as part of the impeller 2 or of the ring element 4, which extends in parallel to the axis 8 and serves for mounting the size reduction tool 6 or the tool module respectively. The supporting means 19 provides a guiding notch 20, which extends particularly in longitudinal direction or respectively axis 8 of the supporting means 19. Thanks to the guiding notch 20, the tool module 10 can be assembled notably easily and precisely always at the same radial position at the supporting means 19 or respectively the impeller 2 or ring element 4.

A tool unit 21 of the tool module 10 as a protrusion for generating a form fit with the guiding notch 20 of the supporting means 19, wherein the protrusion is designed in a way that motion in longitudinal direction of the guiding notch 20 is possible. The tool unit 21 further provides a drill hole, in which a screw can be inserted in order to connect the size reduction tool 6 with the tool unit 21 in a force-fit manner. The size reduction tool 6 therefore also provides a drill hole, namely in form of a particularly radial oriented oblong hole 22. By means of the oblong hole 22, the radial position of the size reduction tool 6 can be notably easily and flexibly adjusted. In a further embodiment, which is not shown, the size reduction tool 6 provides a drill hole and the tool unit 21 has the oblong hole.

A clamping plate 23 connects the tool unit 21 with connected size reduction tool 6 to the supporting means 19 by means of a screw connection.

Therefore, a force-fit and form-fit connection is obtained, which is notably easily detachable.

By means of the tool unit 21 of the tool module 10 it can be achieved that an adjustment of the minimum gap width 9 can be conducted not at the impeller 2 or ring element 4, but notably efficient and with little effort at a separated adjustment station, which is not shown in the figures.

Preferably, the screw connection between size reduction tool 6 and tool unit 21 is chosen in a way that the head of the screw is arranged at the side of the size reduction tool 6 and has such a big circumference that at any adjustment, the oblong hole is covered by the head of the screw. Contamination of the oblong hole through entering materials can thus notably reliably be avoided.

In particular, a light, dry, fibrous material comprises reed, respectively cane.

In particular, a light, dry, fibrous material comprises haulms, strands or fibers from sweet grass such as rice or rice straw, corn, wheat, barley, millet, oat, rye or cattail.

In particular, a light, dry, fibrous material comprises jute, cannabis, flax, kenaf, palm frond or sisal.

In particular, a light, dry, fibrous material comprises coco, soybean, bamboo, peanut shells, light weight wood, cotton, respectively cotton plant or wool.

In particular, a light dry, fibrous material comprises textile waste, vegetable waste, paper waste or other light, dry fibrous waste products.

In particular, with the expression "straw" in the above description and the claims are also meant other lignocellulosic materials with straw-like structure such as reed and rice straw.

The invention claimed is:

1. An apparatus to reduce size of a light, dry, fibrous material comprising a ring element arranged around an axis and configured to rotate about the axis, the ring element including a plurality of tool modules detachably coupled to the ring element around an inner circumference of the ring element, an impeller mounted for rotation about the axis and spaced radially inward of the ring element to form a shearing area between the ring element and the impeller, the impeller including a plurality of tool modules detachably coupled to the impeller around an outer circumference of the impeller, and identical size reduction tools detachably connected to the tool modules of the ring element and tool modules of the impeller, each of the size reduction tools (i) including a tangential leg extending primarily along a tangent plane relative to inner circumference of the ring element and the outer circumference of the impeller and facing the shearing area and (ii) a radial leg extending from the tangential leg radially away from the shearing area relative to the axis to form a L-shape, wherein each of the tangential legs is sized to have an arc length along the tangent plane that is greater than 3° (i) of the inner circumference of the ring element to which it is coupled or (ii) of the outer circumference of the impeller to which it is coupled, and wherein each of the tangential legs is sized to have an arc length along the tangent plane less than 18° (i) of the inner circumference of the ring element to which it is coupled or (ii) of the outer circumference of the impeller to which it is coupled.

2. The apparatus of claim 1, wherein each tangential leg of the size reduction tools has a length in the range of 30 mm to 80 mm.

3. The apparatus of claim 1, wherein each tangential leg of the size reduction tools includes a front edge, a back edge, and a side-face that extends between and interconnects the front edge and the back edge and faces the shearing area to form an acute angle with the tangent plane to maintain a controlled gap between the side-faces of the size reduction tools coupled to the ring element and the side-faces of the size reduction tools coupled to the impeller.

4. The apparatus of claim 3, wherein the front edge of each tangential leg extends parallel to the axis.

5. The apparatus of claim 3, wherein the front edge of each tangential leg is arranged angular to the axis.

6. The apparatus of claim 3, wherein the impeller is configured to rotate in a first direction and the ring element is configured to rotate in a second direction that is opposite the first direction to produce a relative shearing motion between the size reduction tools coupled to the ring element and the size reduction tools coupled to the impeller.

7. The apparatus of claim 6, wherein the gap between the side-faces of the size reduction tools coupled to the ring element and the side-faces of the size reduction tools coupled to the impeller increases during the shearing motion.

8. The apparatus of claim 3, wherein a radius from the axis to the back edge of the tangential leg is smaller than a radius from the axis to the front edge of the tangential leg.

9. The apparatus of claim 3, wherein the side-face of each tangential leg is formed to include rectangular notches.

10. The apparatus of claim 3, wherein the side-face of each tangential leg is formed to include polygonal saw teeth.

11. The apparatus of claim 3, wherein the side-face of each tangential leg is formed to include rounded, U-shape notches.

12. The apparatus of claim 1, wherein the impeller is configured to rotated a first speed and the ring element is configured to rotate at a second speed that is different than the first speed of the impeller.

13. The apparatus of claim 1, wherein the impeller is configured to rotate in a first direction and the ring element is configured to rotate in a second direction that is opposite the first direction to produce a relative shearing motion.

14. The apparatus of claim 1, wherein each of the tool modules includes a support, a tool unit configured to mount one of the size reduction tools, and a clamping plate configured to clamp the tool unit to the support.

15. The apparatus of claim 14, wherein the support is shaped to provide a guiding notch to locate the tool unit on the supporting means.

16. The apparatus of claim 15, wherein each of the radial legs is coupled either to the ring element or the impeller by a fastener that extends through the radial leg.

* * * * *